US008203457B1

(12) United States Patent
Emello et al.

(10) Patent No.: US 8,203,457 B1
(45) Date of Patent: Jun. 19, 2012

(54) PORTABLE CURRENCY READER AND PROCESS FOR DETECTION OF CURRENCY VALUE

(75) Inventors: David Vito Emello, Belmont, MA (US); Steven S. Heflin, Foxboro, MA (US); James G. Calvin, Attleboro, MA (US)

(73) Assignee: Dacasa, Inc., Belmont, MA (US)

( * ) Notice: Subject to any disclaimer, the term of this patent is extended or adjusted under 35 U.S.C. 154(b) by 487 days.

(21) Appl. No.: 12/498,637

(22) Filed: Jul. 7, 2009

Related U.S. Application Data

(60) Provisional application No. 61/134,116, filed on Jul. 7, 2008.

(51) Int. Cl.
*G08B 17/12* (2006.01)

(52) U.S. Cl. ..... 340/600; 340/540

(58) Field of Classification Search ..... 340/540, 340/600

See application file for complete search history.

(56) References Cited

U.S. PATENT DOCUMENTS

| | | | | |
|---|---|---|---|---|
| 7,753,189 | B2 * | 7/2010 | Maier et al. | 194/206 |
| 7,980,378 | B2 * | 7/2011 | Jones et al. | 194/217 |
| 2003/0081824 | A1 * | 5/2003 | Mennie et al. | 382/135 |
| 2006/0237541 | A1 * | 10/2006 | Downing | 235/462.01 |
| 2010/0230615 | A1 * | 9/2010 | MacPherson et al. | 250/488.1 |

* cited by examiner

*Primary Examiner* — Travis Hunnings
(74) *Attorney, Agent, or Firm* — Burns & Levinson LLP; Stephen Y. Chow

(57) ABSTRACT

A portable currency reader and process for detecting the value of currency comprising the detection and reading of the security stripe in currency swiped through the reader by sensing color intensities in light transmitted or refracted through the swiped bill illuminated with ultraviolet radiation and correlating a local maximum intensity of the fluoresced color associated with the value of the currency with a maximum of a calculated composite value of refracted light associated with a discontinuity indicating the presence of the security stripe.

11 Claims, 5 Drawing Sheets

PORTABLE CURRENCY READER AND PROCESS FOR DETECTION OF CURRENCY VALUE

CROSS REFERENCE TO RELATED APPLICATIONS

This application claims the benefit of U.S. Provisional Application No. 61/134,116, filed Jul. 7, 2008, which is incorporated herein by reference in its entirety.

FIELD OF THE INVENTION

The present disclosure relates generally to currency detection and verification.

BACKGROUND OF THE INVENTION

Currency detection and verification has been performed in complex currency processing devices such as those described in U.S. Pat. No. 5,960,103 to Graves et al. for "Method and Apparatus for Authenticating and Discriminating Currency"; U.S. Pat. No. 6,883,706 to Mastie et al. for "Point-of-Sale Bill Authentication"; and U.S. Published Application No. 2007/0108265 A1 disclosing "Currency Note Identification and Validation."

None of these is suitable for a portable, hand-held currency detection and verification device, such as would be useful for a visually-impaired user to verify currency to be paid or received.

SUMMARY OF THE INVENTION

The device of this invention uses ultraviolet radiation emitted from an LED array to illuminate the security thread which is embedded in United States paper currency. The ultraviolet radiation will make the security stripe glow in its prescribed color based on its value:

| Value of note | Corresponding color |
|---|---|
| $5 | Blue |
| $10 | Red |
| $20 | Green |
| $50 | Yellow |
| $100 | Pink/Orange |

The device uses one or more color sensors to detect the color thus determining the value of the currency. A sensor is positioned such that the currency is swiped between the LED array and the sensor so that the color sensor detect both the light transmitted through the currency as well as the light emitted by the security thread. The color is detected where one or more peaks of color coincides with the peak of a calculated composite value or signal that changes significantly upon the passage of the security thread representing a discontinuity. This configuration and process allows for a compact, portable device for detecting or verifying the value of paper currency with a security thread or stripe that glows in a specified color in response to stimulating radiation.

In an embodiment for use by the visually impaired, the device provides an auditory alert of the value detected. In another embodiment, for the visually and hearing impaired, the device may provide a vibration alert. In yet another embodiment, the device may have a shock alarm such that if the device is dropped a sensor will sound an alarm to allow the user to locate it audibly.

DETAILED DESCRIPTION

Figure 1:
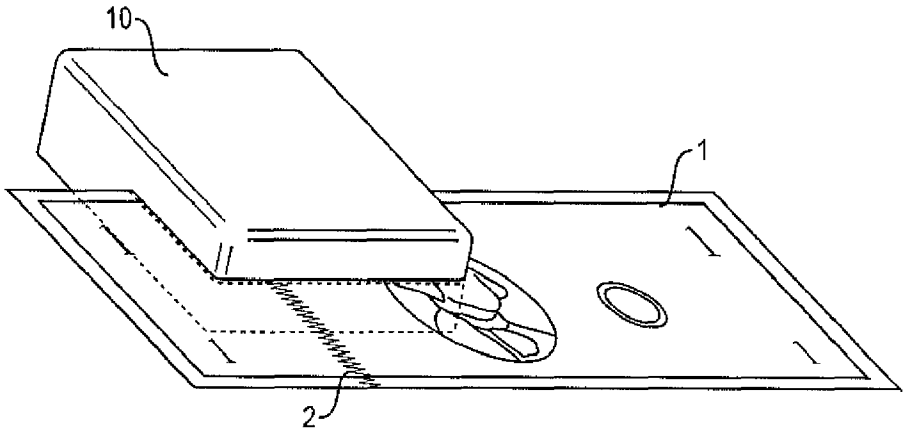
FIG. 1 shows a perspective view of the portable currency reader reading paper currency.

FIG. 1 shows a view of an embodiment of the currency reader 10 of the invention with paper currency bill 1 being swiped through it. The currency bill 1 is flat, rectangular and translucent with an embedded stripe or thread 2 including fluorescing material responsive to radiation of a stimulating frequency, in the ultraviolet region in the case of contemporary United States currency, disposed perpendicularly to the major axis of the bill, that is, parallel to the end edges. The notch for the swiping should be wide enough allow the bill to be swiped with little resistance and not so wide as to cause mis-registration of the bill. A width of approximately 0.75 inches has been found to be effective. The depth of the notch should allow one or more sensors to examine the bill at a point or points away from the edge of the bill to avoid possible edge effects. A depth of 0.125 inches has been found to be effective. The length of the notch should facilitate longitudinal registration of the bill as it is being swiped.

Figure 2:
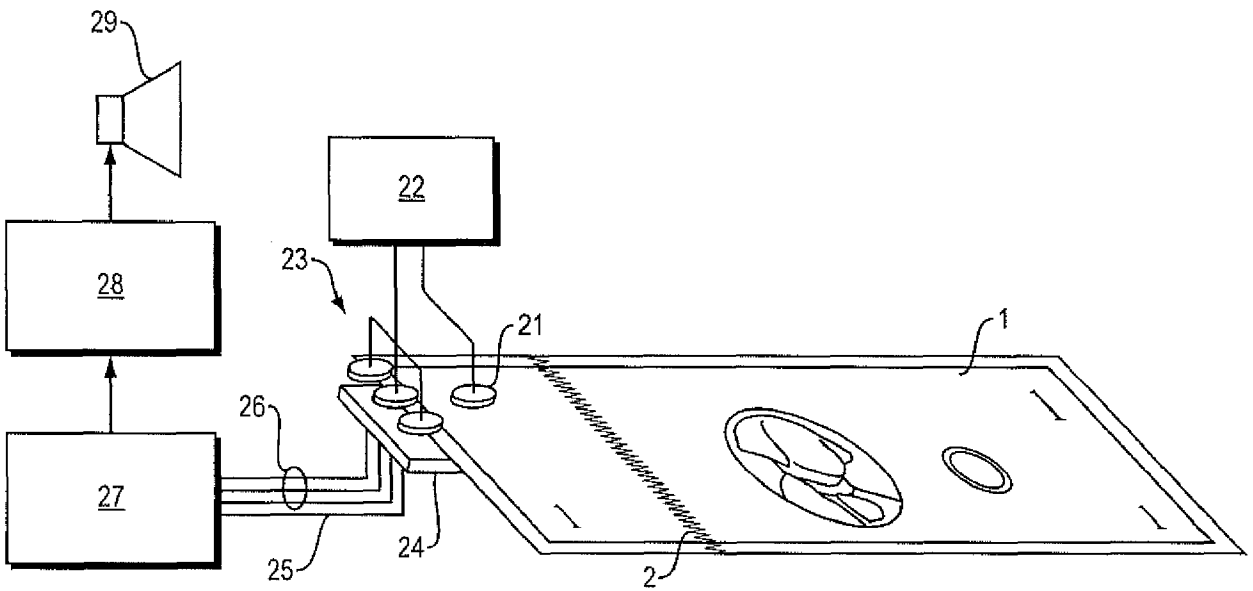
FIG. 2 shows the primary electrical components of the system.

FIG. 2 shows the major components of the currency reader. The power supply, which may be a battery, capacitor, kinetic harvesting device, thermal harvesting device, an AC adaptor or a combination thereof, is not shown, but is understood to be included to power the shown components. A start switch 21 starts the processor to illuminate sources 23 then repeatedly read the color sensor(s) as a bill 1 is being swiped, causing sensor circuitry 22 to provide the series of values resulting from the illumination of the bill. A sampling every 12.5 milliseconds has been found to be effective. Three ultraviolet light-emitting diodes ("UV-LED's") have been found to be an effective light source. The light source is driven by a software controllable pulse-width-modulation circuit which the processor uses to automatically calibrate the light level.

Sensors 24 are disposed opposite the illuminating sources 23 such that as the bill 1 is being swiped, the radiation from illuminating sources 23 passes through the bill 1 and is partially transmitted or refracted through the bill and otherwise reflected, absorbed, or changed into radiation of different frequency. As the stripe 2 passes between sources 23 and sensor(s) 24, it fluoresces a characteristic color, which causes transmission of the illuminating radiation to change significantly as measured by the sensor(s) 24. It has been found that with U.S. currency, particularly worn bills that may embed foreign matter, produce higher peaks of characteristic colors away from the stripe than at the stripe, leading to false positives if a discontinuity in sensed light is not taken into account as indicating the location of the stripe. This discontinuity is detected as a calculated composite value described below.

A variety of ways of sensing the intensities of the characteristic color and the overall transmissivity of the bill are possible, including a dedicated sensor of the characteristic color and of the transmitted radiation disposed at the same longitudinal point to register the passage of the stripe 2 between the illuminating source 23 and the sensors 24. It has been found that a Taos USA Color Sensor [http://www.taos-inc.com/] having four 16 bit digital outputs, three channels 26 measuring Red, Green and Blue ("RGB") color components and a fourth, "clear" channel 25 indicating overall brightness or uv light source level may be processed by processor 27 (e.g., TI msp430f5418) programmed to analyze the values provided by color sensor. The "clear" channel signal may be used to detect the security-stripe-characteristic-discontinuity in an alternative embodiment, but it has been found that the following processing of the RGB signals is effective. Although the processing in this embodiment is performed in digital mode, it should be understood that the process may be performed in analog mode using know analog circuitry for accumulating, dividing, differentiating, integrating and comparing.

Figure 3:
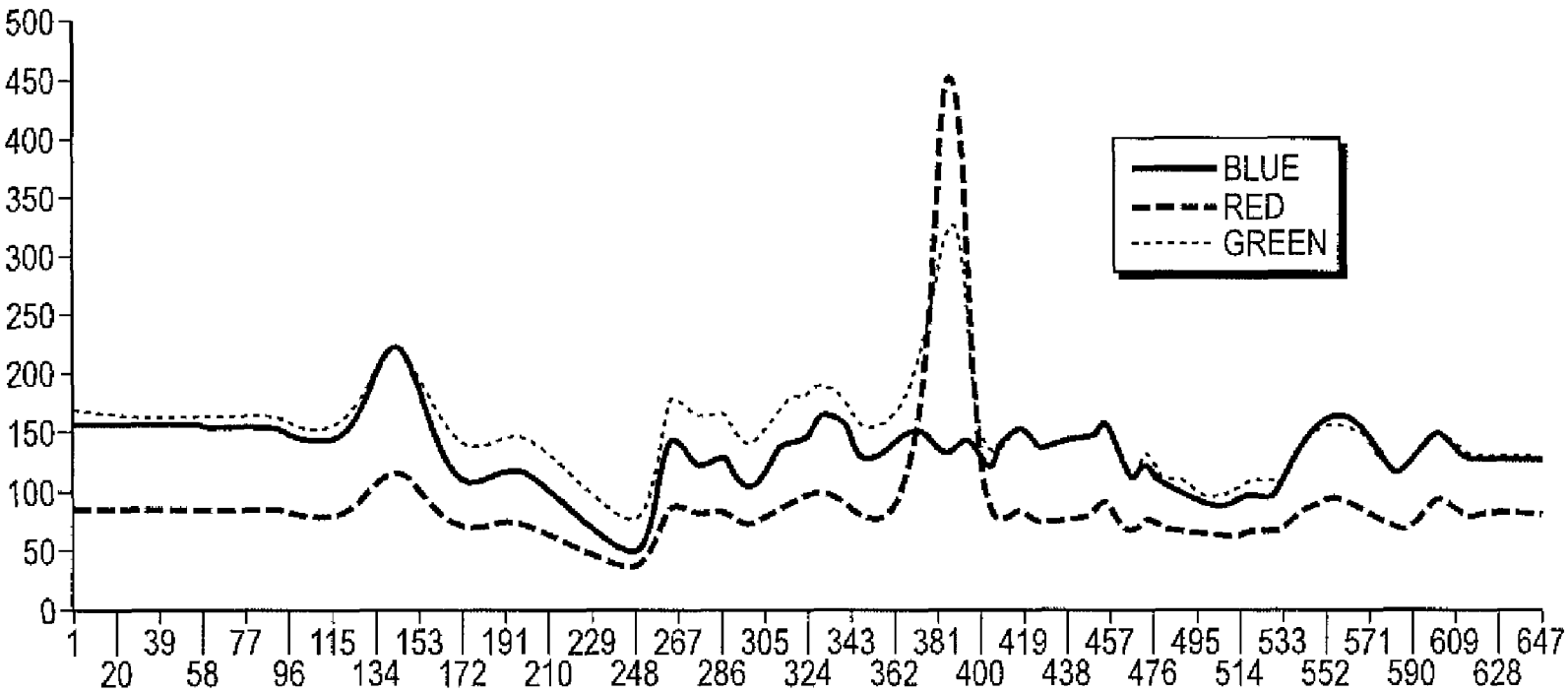
FIG. 3 shows the raw RGB color data values versus sample number for a $10 bill.
Figure 4:
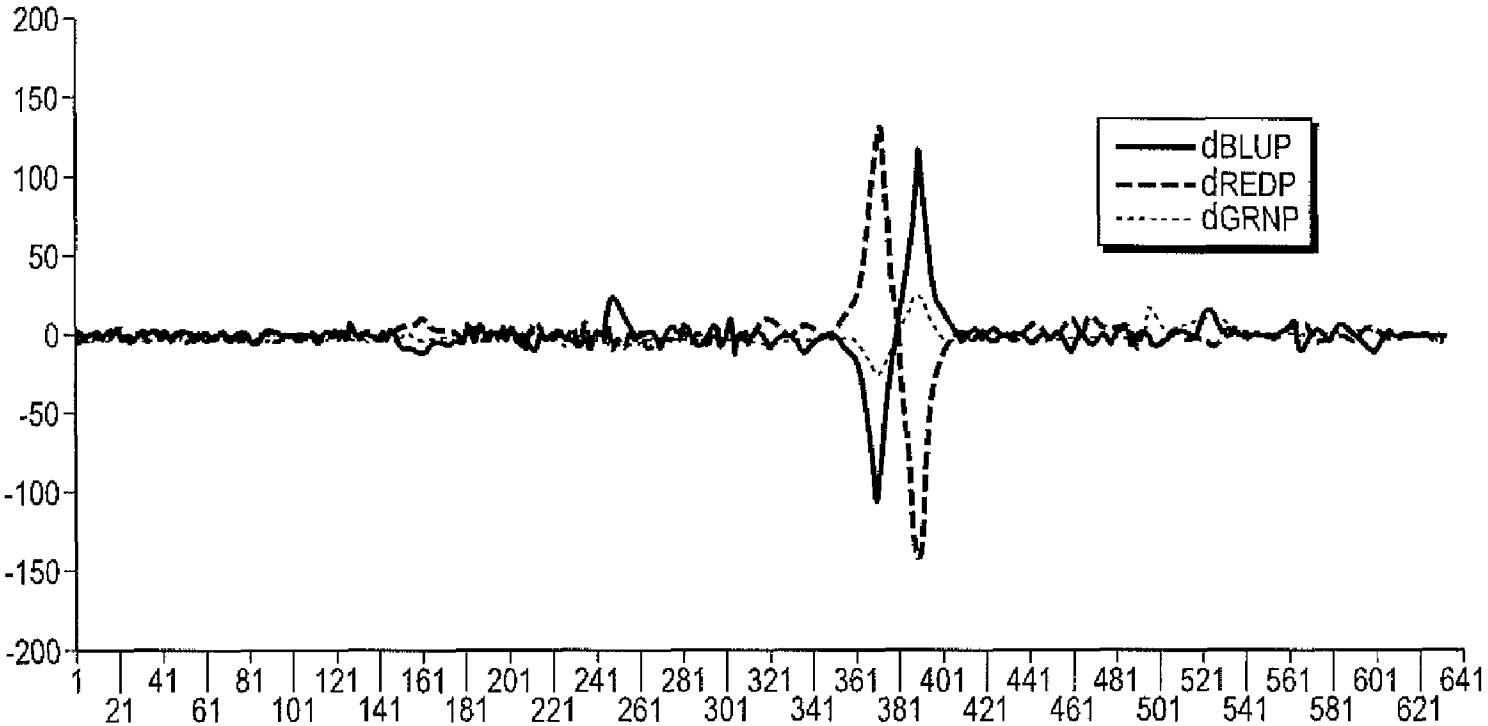
FIG. 4 shows the first derivative of RGB color percentage ("DCP") versus sample number for a $10 bill.

As the bill 1 passes between the UV-LED's 23 and the color sensor 24, a sample is acquired from the color sensor every 12.5 milliseconds. FIG. 3 shows a plot of raw RGB amplitude values along the time, or sample numbers, of the swiping of bill 1, in this case, a $10 bill. After each sample is received, the RGB color values are added together to yield a Color Total. Then each color is divided by the Color Total, yielding its Color Percentage. Each Color Percentage from the previous sample is subtracted from the current Color Percentage to yield the first derivative of the color percentage ("DCP"). The result is multiplied by 5000 to yield an integer DCP value for the given color. The DCP values are not sensitive to the calibration of the UV-LED and color sensor pair. When the security stripe 2 passes between the UV-LED 23 and color sensor 24, changes in the color percentages occur according to the properties of the security strip. FIG. 4 shows the calculated DCP values for a $10 bill.

Figure 5:
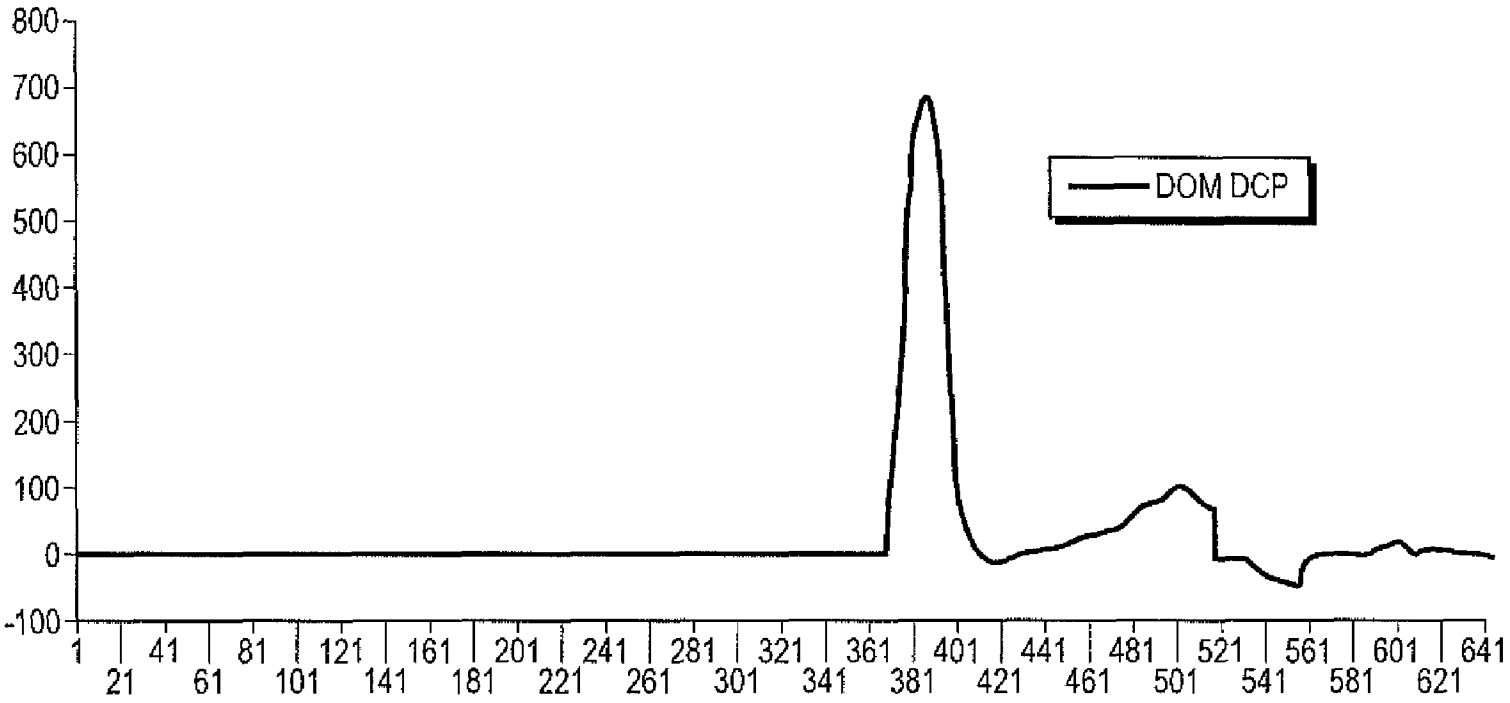
FIG. 5 shows the dominant DCP integration versus sample number for a $10 bill.

When the security stripe 2 is between UV-LED 23 and the color sensor 24, the dominant RGB colors refracted by the security stripe cause the DCP values to peak. When the rising edge of a peak is detected (above 40 in the example of FIG. 4) in an DCP value, it becomes the Dominant DCP. At the same instant, any other DCP colors that are negative in value, are inhibited from becoming a Dominant DCP until it cycles to a positive value two times. This avoids the reactive peak in secondary color(s) that always occurs after the meaningful peak. The Dominant DCP is integrated, and when the integration peaks, a peak measurement snapshot is taken. FIG. 5 shows the DDCPI for the $10 bill. This is the calculated composite value used to indicate the presence of the security stripe.

Figure 6:
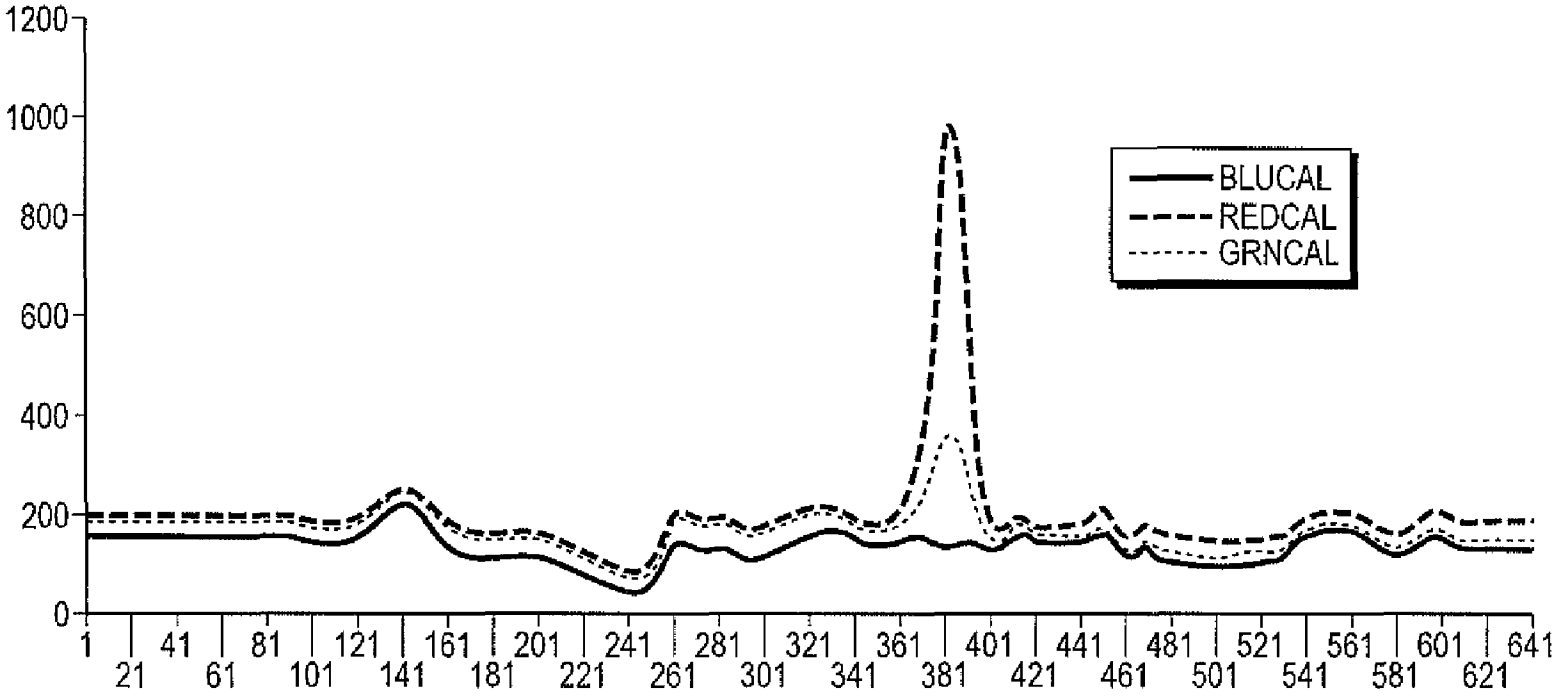
FIG. 6 shows calibrated RGB color values versus sample number for a $10 bill.

The DCP values also serve as trigger to capture values used to calibrate the peak measurements. When the total of the absolute value of DCP values is less than 7 (in FIG. 4) for two consecutive samples, it indicates that the color measurements are stable with respect to each other. Each time this condition is detected, the color measurements are totaled and compared to the previously saved minimum and maximum. At the end of the scan, there will exist two sets of measurements, one where all three colors total up to the minimum, and a second point where all three total up to the maximum. Since Blue is always the color with the highest value, the algorithm calculates calibration coefficients (mx+b where m and b are the coefficients) such that all three colors have the same value that Blue has at low and high points. The same mx+b calibration is then applied to the peak measurement values which compensates for variations in the UV-LED and color sensor. FIG. 6 shows the same values from the raw data FIG. 3 after the calibration has been applied. The Green value at the peak is lower after calibration leaving the Red standing out all by itself which is a clear indication of a $10 bill.

Upon the completion of the swipe, if a peak in the Red-Green-Blue values coincides with the calculated composite value, the DCCPI in the embodiment, it is determined that the security stripe of a currency bill associated with fluorescence of that characteristic color has been read. Processor 28 then provides an indicator of the value of the currency bill associated with the characteristic color of the security stripe. This may be output on a transponder such as speaker 29 or in a visual or tactile (vibrator) indicator.

The use of solid state components in this device allows for a compact form factor and usability in a point-of-sale situation for verifying the security stripes of bills otherwise determined by visual inspection. It is also suitable for further scaling down for use by the visually impaired to identify or verify currency with partial visual and at least tactile recognition. In another embodiment, particularly helpful for the visually impaired, the device may have a shock alarm such that if the device is dropped a sensor will sound an alarm to allow the user to locate it audibly. In another embodiment, for the visually and hearing impaired, the device may provide a vibration alert.

What is claimed is:

1. Apparatus for detecting the value of a currency bill with a security stripe that fluoresces upon illumination by radiation of a stimulating frequency in a color uniquely associated with the value of the currency, said apparatus comprising:

a) a radiation source emitting radiation at said stimulating frequency;

b) at least one sensor, disposed opposite said radiation source and spaced to allow swiping of said bill between them, that provides a signal output varying directly with the sensed intensity of said associated color;

c) at least one sensor, disposed opposite said radiation source, spaced to allow swiping of said bill between them, and if different from said first said sensor, positioned such that said security stripe passes said sensors simultaneously upon swiping of said bill, that provides a signal output varying directly with the sensed intensity of light of multiple frequencies including those of said associated color and at least one other; and d) circuitry adapted to calculate a composite value indicating a discontinuity of refraction of said light of multiple frequencies associated with the presence of said security stripe and to indicate said currency value if the maximum of said calculated composite value across the swiping of said currency occurs at a time coincident with a local maximum of the sensed intensity of said associated color.

2. The apparatus of claim 1 wherein said radiation source is at least one ultraviolet light-emitting diode, said sensors comprise sensors for the colors red, green and blue and said circuitry is adapted to:

d1) add the signal outputs of said red, green and blue sensors to yield a color total;

d2) divide said signal outputs by said color total to yield their respective color percentages;

d3) calculate the first derivatives relative to time of said color percentages;

d4) determine a dominant derivative of color percentage; and d5) integrate said dominant derivative to determine said calculated composite value.

3. The apparatus of claim 2 wherein said measurements are performed at discrete time intervals with outputs in digital form and said circuitry comprises a digital logic processor programmed to perform said calculation and said determination of coincidence.

4. The apparatus of claim 1 included within a housing of scale for hand-held use and provided with a notch for swiping said bill, said radiation source disposed on one side of said notch and said sensors disposed on the opposite side of said notch.

5. The apparatus of claim 4 wherein said indicator comprises a transducer emitting sound signals.

6. The apparatus of claim 4 wherein said indicator comprises a visual display.

7. The apparatus of claim 4 wherein said indicator comprises a transducer for producing a pattern of vibrations of the housing.

8. The apparatus of claim 5 comprising a shock alarm.

9. A method for detecting the value of a currency bill with a security stripe that upon illumination by radiation of a stimulating frequency fluoresces in a color uniquely associated with the value of the currency, said method comprising the steps of:

a) passing said bill lengthwise past a radiation source emitting radiation at said stimulating frequency;

b) measuring, on the side of said bill opposite that facing said radiation source, the intensity of said associated color;

c) measuring, on the side of said bill opposite that facing said radiation source and at the same lengthwise position relative to the bill as said measuring of the intensity of said associated color, the intensity of light of multiple frequencies including those of said associated color and at least one other;

d) calculating a composite value indicating a discontinuity of refraction of said light of multiple frequencies associated with the presence of said security stripe; and e) indicating that the bill is of said value if the maximum of said calculated composite value occurs at a time coincident with a local maximum of measured intensity of said associated color.

10. The method of claim 9 wherein said illumination is by ultraviolet radiation, said measurements are performed by measuring the intensities of the colors red, green and blue, and said composite value is calculated by the steps of:

d1) adding said red, green and blue intensities to yield a color total;

d2) dividing the red, green and blue intensities by said color total to yield their respective color percentages;

d3) calculating the first derivatives relative to time of said color percentages;

d4) determining a dominant derivative of color percentage; and d5) integrating said dominant derivative to determine said calculated composite value.

11. The method of claim 10 wherein said measurements are performed at discrete time intervals with outputs in digital form.

* * * * *